United States Patent [19]

Hansson

[11] Patent Number: 4,494,249

[45] Date of Patent: Jan. 22, 1985

[54] GLOVE

[76] Inventor: Erik Hansson, Box 137, Sandviken, Sweden, S-811 23

[21] Appl. No.: 519,919

[22] PCT Filed: Dec. 29, 1982

[86] PCT No.: PCT/SE82/00441

§ 371 Date: Aug. 3, 1983

§ 102(e) Date: Aug. 3, 1983

[87] PCT Pub. No.: WO 83/02217

PCT Pub. Date: Jul. 7, 1983

[30] Foreign Application Priority Data

Dec. 30, 1981 [SE] Sweden ..... 8107841

[51] Int. Cl.[3] ..... A41D 19/00

[52] U.S. Cl. ..... 2/161 R; 2/163; 2/169

[58] Field of Search ..... 2/158, 159, 161 R, 161 A, 2/163, 165, 169, 16, 20, 22

[56] References Cited

U.S. PATENT DOCUMENTS

| | | | |
|---|---|---|---|
| 731,572 | 6/1903 | Hoegren | 2/169 |
| 1,641,701 | 9/1927 | Spivak | 2/169 |
| 1,846,835 | 2/1932 | Bruckler | 2/16 |
| 2,610,326 | 9/1952 | Sabin | 2/161 R |
| 3,997,922 | 12/1976 | Huhta | 2/161 A |

FOREIGN PATENT DOCUMENTS

| | | | |
|---|---|---|---|
| 710394 | 6/1954 | United Kingdom | 2/161 R |

*Primary Examiner*—Henry S. Jaudon
*Assistant Examiner*—Tracy Graveline
*Attorney, Agent, or Firm*—Zarley, McKee, Thomte, Voorhees & Sease

[57] ABSTRACT

A glove comprising a palm portion having side portions (4, 5) projecting upwardly along the outer sides of the glove. To permit a curving of the palm portion in the area of the knuckle joints, the upwardly projecting side portions (4, 5) are in said knuckle joint area provided with a cut (13) that is widened in the assembled condition of the glove. To achieve in this connection the required pliability and flexibility of the glove, the back portion is extended with respect to corresponding parts of the palm portion of the glove.

10 Claims, 10 Drawing Figures

GLOVE

FIELD OF INVENTION AND PRIOR ART

This invention is related to a glove, in particular a working glove, ski glove or similar.

It is desired to adapt gloves to the anatomy of the hand. By way of example, gloves have been suggested the back portion of which have one or more parts that are extended with respect to corresponding parts of the palm portion of the glove to adapt the glove to the form of the hand in its rest position or else in a position having one or more fingers curved. Thereby, less wrinkling of the inside glove material will occur. Such wrinkling is irritating and deteriorates the clasping capacity besides that it requires a great deal of force that must be developed by the fingers of the user. Moreover, such an extension of the back portion of the glove with respect to the palm portion is anatomically expedient since the fingers in their relaxed condition are projecting somewhat curved from the metacarpus.

In gloves of the kind here discussed it is the palm portion that is chiefly exposed to wear. The palm portion must accordingly be wear resistant and to this end coarse leather material is generally used for the palm portion. The back portion is, however, generally not as much exposed to wear so that for the same a less wear resistant and thus less expensive material can be accepted, generally textile material, which however in the area of the knuckles and/or finger-tips can be reinforced with small leather pieces.

A glove is already known that presents a very good wear resistance. This glove is popularly quoted as being of the "American type"; the basic type as such has been in existence for at least 40 years and it can be said without exaggeration that it, in particular as a working glove, is at present quite predominant all over the world. The cause of the wide spreading of this type of glove is the fact that the hand is through this glove clothed and protected by leather over all the surface that is primarily exposed to wear, i.e. except the inside of the hand also the sides of the hand; this applies also to the sides of the fingers. Further a minimum number of seams occur on the inside of the hand and fingers which is most exposed to stresses and wear. Even though the so-called American type of glove was considered the best one up to now, it does not follow that it was quite perfect. The problem was that the turned up side portions caused a considerable resistance to bending the glove in closing one's hand. To eliminate this problem to the utmost possible extent, too wide and large gloves have been used. A consequence was a poor fit and folds inside the hand and a risk for accidents, as the protruding material might get caught in machines etc and cause severe hand injuries.

SUMMARY OF THE INVENTION

The object of the present invention is now to develop further the glove described above of the "American" or similar type that has strong leather material that projects from the palm portion upwardly along the sides of the metacarpus portion of the glove and the sides of the finger portions.

This object is achieved through the glove according to the invention, the main characteristics of which are defined in the appendent claim 1.

By piercing in this manner the strong leather material at the glove sides and in the vicinity of the knuckle joints or possibly the finger joints and assembling the glove while providing a curvature of the palm portion in the joint area discussed, a substantially better adaptation of this glove to the anatomy of the hand is achieved at the same time as less effort is required to close the hand, since, through the curvature in the joint area, less wrinkling will be obtained of the palm material.

BRIEF DESCRIPTION OF THE DRAWINGS

With reference to the appended drawings there follows below a more specific description of embodiments of the invention quoted as examples. In the drawings.

DETAILED DESCRIPTION OF PREFERRED EMBODIMENTS

Figure 1:
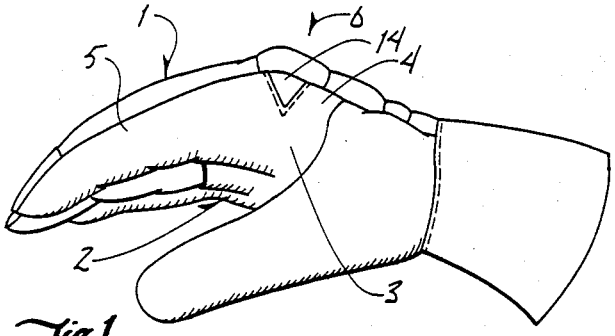
FIG. 1 is a perspective view of a glove according to the invention.

In FIG. 1 a glove of the so-called "American type" is illustrated. The glove has a dorsal side or back side generally designated 1 and a palmar or inside portion generally designated 2. The glove is primarily designed as a working glove and has its palm portion made of a relatively wear resistant material, generally leather. The back side can, however, be of a less wear resistant and more flexible textile material or similar.

The back portion 1 is generally extended with respect to the palm portion of the glove so that the glove is adapted to the form of a hand in its rest position and permits closing of the hand without a too substantial wrinkling of the palm portion. Material portions integrally associated with a material portion 3 forming part of the palm porting 2 project upwardly along the side of the glove as appears in FIG. 1 as regards one outer side of the glove. Said material portions consist more specifically of a portion 4 adjoining to the thumb base and a portion 5 extending along the so-called radial side of the index. The area in which the knuckle portions of the hand are intended to be located is denoted 6 in FIG. 1.

Figure 2:
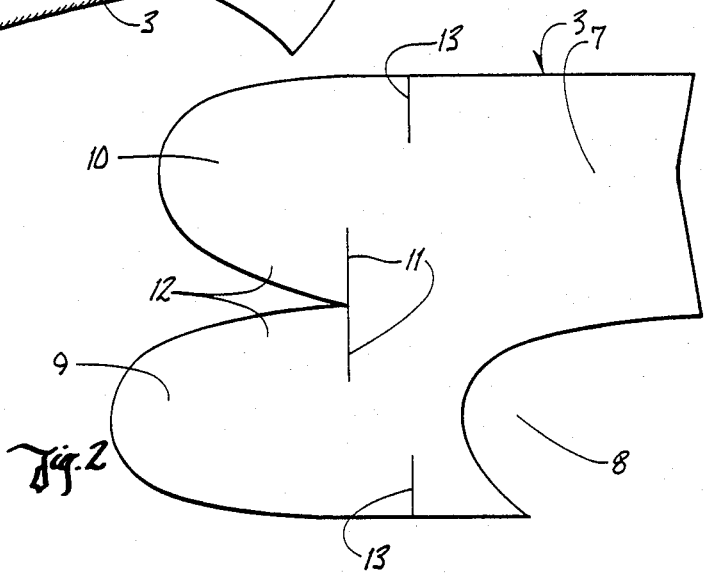
FIG. 2 is a view of a piece of material for manufacturing the glove according to FIG. 1.
Figure 3:
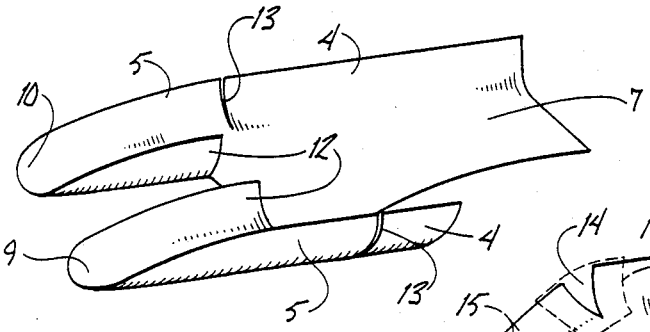
FIG. 3 is a perspective view of the piece of material according to FIG. 2 having the sides of two finger portions and a metacarpus portion turned up.

In FIGS. 2 and 3 the material piece 3 is illustrated that takes part in forming the palm portion of the glove. Said piece 3 has a metacarpus portion 7 with a space 8 for the application of material pieces forming the thumb. The material piece 3 is integrally joined to two finger portions 9 and 10 respectively for the index and the little finger. Between the finger portions 9 and 10 is a cut 11. The finger portions 9, 10 have material portions 12 which thanks to the slit 11 can be turned up to the position according to FIG. 3 while forming side pieces on the inner sides of the index and the little finger. In analogy with what applies to the glove side situated next to the thumb also the outer side of the glove facing away from the thumb has an upwardly projecting material portion 4 extending along the metacarpus and besides a material portion 5 projecting upwardly from the lower side of the little finger along the outer side of the little finger.

The portions of the glove designed for the middle finger and the ring finger are formed of one or possibly two separate material pieces that are in a conventional manner sewed on the material piece 3 between the finger portions 9 and 10. These finger portions designed for the middle finger and the ring finger are analogous to the finger portions 9 and 10 for the index and the little finger in the sense that also the former ones have side portions analogous to the side portions 5 and 12 described and projecting upwardly from the palm portion of the middle finger and the ring finger portions.

If now a conventional glove would have been considered, the material piece forming the back portion 1, would after the finger portions for the middle finger, the ring finger and the thumb having been fastened to the material piece 3, have been sewed on the plam portion thus obtained in substantially the condition appearing in FIG. 3.

According to the invention the material piece 3 is however provided with cuts 13 in the side portions of the glove, more specifically those portions that are turned up from the palm side. The cuts 13 are in the example situated at opposite sides of the glove and are further situated in a plane extending across the longitudinal direction of the glove and coinciding substantially with or being situated in the vicinity of the area of the glove, in which the knuckle joints of the hand are intended to be located. The purpose of these cuts 13 is that they, as appears by FIG. 4, admit a folding or curving of the material piece 3 about an imagined hinge across the longitudinal direction of the glove in the knuckle joint area under concurrent widening of the cuts into triangular openings 14. As appears by FIGS. 1 and 4 the cuts 13 permit a relatively sharp curvature at these slits, which is advantageous since it corresponds substantially better to the anatomy of the hand than the regular slight curvature over generally the whole length of the glove as has been used previously. According to the invention the material piece(s) forming the back portion 1 is (are) sewed on to the palm material piece 3 (completed with lacking finger and thumb portions) in such a manner that the cuts will remain permanently widened as appears by FIG. 1. This implies that the previously mentioned, relatively substantial curvature in the area of the cuts 13 will be maintained so that the palm portion 7 and finger portions 9, 10 of the material piece 3 will obtain a considerable inclination with respect to each other.

Figure 4:
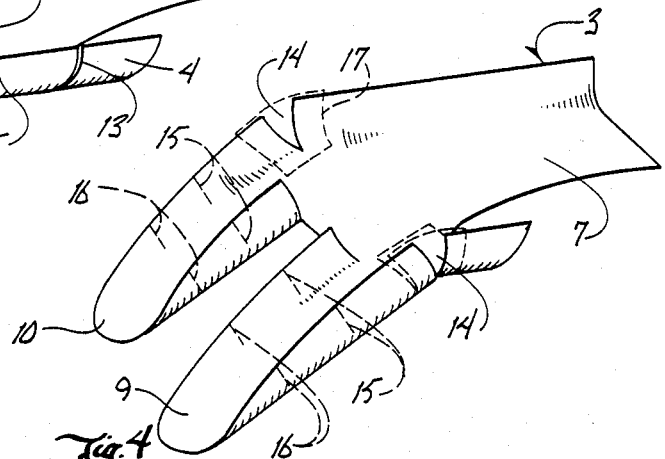
FIG. 4 is a view illustrating the piece of material according to FIG. 3 after bending along a line substantilly parallel to the localization of the knuckle joints in the imagined, finished glove.

It is described above how two cuts are made on the glove sides in the knuckle joint area. It is understood that instead of only one cut on each glove side it would have been possible to provide two or possibly three cuts, so that the curvature of the material piece 3 in the knuckle joint area could have been made somewhat less sharp. It is further described above how cuts 13 are made in the knuckle joint area solely. It would of course be possible to apply the same principle in connection with the remaining finger joints to make also the form of the fingers adapt better to the form of the hand, since the fingers of the hand are not at all evenly curved but the curvature appears at the joints. In FIG. 4 it is indicated with dashed lines at 15 and 16 respectively how the side portions 5 and 12 of the finger portions 9, 10 could be provided with cuts at the so-called distal and proximate interphalangeal joints. Also these slits should be widened at the time when sewing on is done relatively to the back material pieces. What was mentioned regarding the cuts 15 and 16 indicated will of course also apply to the finger portions that do not appear by FIG. 4. It is to be noted that, from an ergonomic point of view, it is more important with the cuts indicated by 15 than those indicated by 16.

As indicated by dashed lines in FIG. 4 the palm material piece 3 at the inner side of the widened cuts 13 may be provided with closing pieces 17, which close the openings 14 and prevent admission of dust etc. Said closing pieces can be sewed or glued on.

The extra curvature of the palm portion in the area of the knuckle joints and/or the finger joints according to the invention implies that it is essential to see to it that the material pieces forming the back portion or portions of the glove should have a sufficient excess length relatively to the palm portion so as to permit a pliable closing of the glove.

Figure 5:
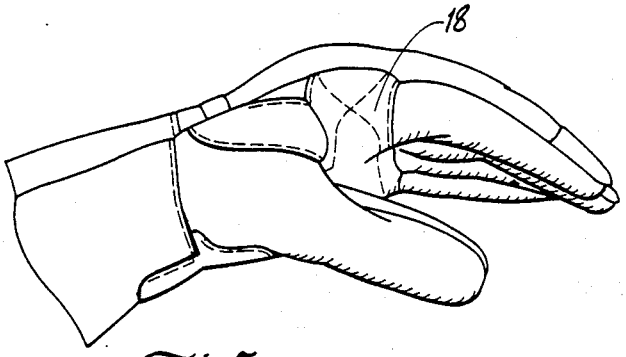
FIG. 5 is a prespective view of a somewhat modified glove.

In FIG. 5 an embodiment is illustrated that quite corresponds to that already described with the sole exception that the closing pieces 17 at the inner side of the material piece 3 treated with preference to FIG. 4 have been left out and instead a stronger reinforcement piece 18 has been disposed across the palm portion at the outer side of the same. The reinforcement piece covers the openings 14 on the two outer sides of the glove.

Figure 6:
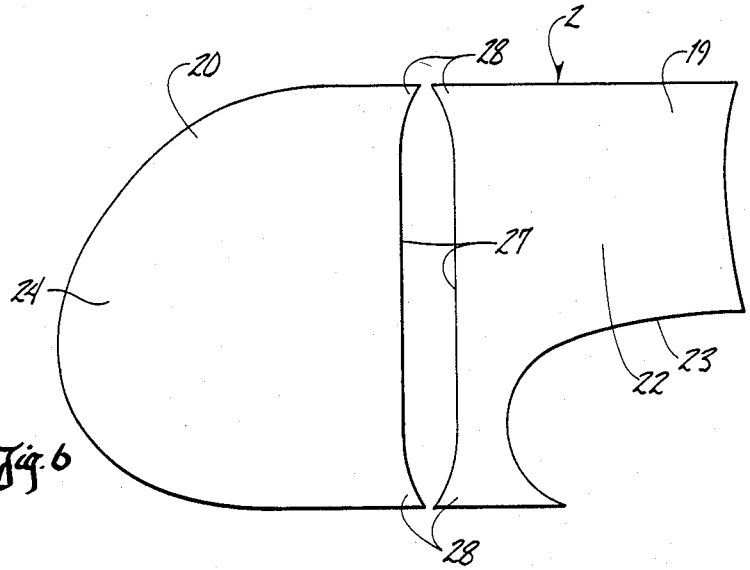
FIG. 6 is a plan view of two material pieces designed to be comprised in the palm portion of a glove that is here represented as being of a "mitten type" but that can as well have two or more fingers.
Figure 7:
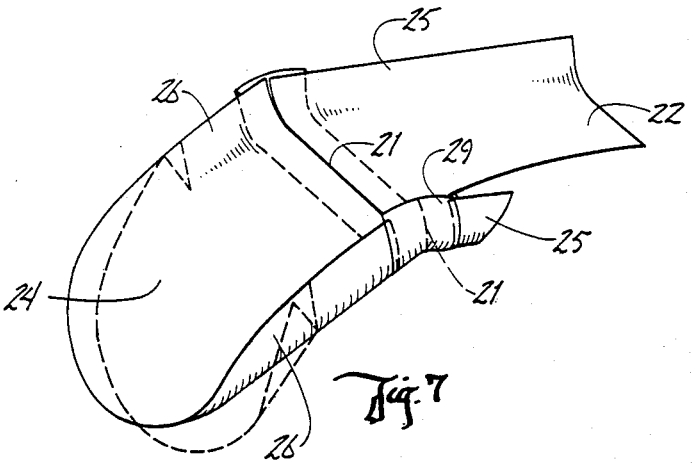
FIG. 7 is a view illustrating the material pieces according to FIG. 6 joined in such a manner that an angular position between the material pieces will arise in the area of the joining.

In FIGS. 6 and 7 an embodiment is illustrated that is of a so-called "mitten type". Only the palm portion 2 is illustrated but this will suffice for a complete understanding of how the finished glove is built up. The palm portion is formed of two material pieces 19, 20, that are assembled along a transverse joint 21 situated in the area of the knuckle joint area of the glove in such a manner that the finished glove will obtain a curvature corresponding to the knuckle joint curvature in this area. The material piece 19 forms the metacarpus portion 22 of the palm portion and has in a conventional manner space for thumb portions at 23. The material piece 20 has a portion 24 designed to be situated below all of the four fingers except the thumb. As appears by a comparison with FIG. 7 the material pieces 19 and 20 have side portions 25, 26 that project upwardly from the palm side along the outer sides of the glove. The projecting material portions 25 are in this connection situated along the metacarpus whereas the material portions 26 are situated along the outer sides of the index and the little finger. As mentioned the material pieces 19 and 20 are joined in a manner to make the palm portions 22 and 24 adopt an angular position with respect to each other through the curvature in the area of the joint 21. As appears by FIG. 6 the material pieces 19 and 20 have edges 27 designed for joining, said edges presenting in the planar, developed condition of the material pieces, at the sides of the material pieces, approximately triangular projections or gores 28. If the edges 27 now are sewed together "butt on butt" a tendency will be obtained in the joint area that the joint material pieces will adopt the position according to FIG. 7.

To improve the conformation of the material piece 20 to the form of the fingers it would be possible, as indicated with dashed lines in FIG. 7, to provide the side pieces 26 of the finger portion 24 with cuts in the area of at least the proximal interphalangeal joints, which cuts shall be in the manner described with reference to FIGS. 1–4 widened at the time for sewing on between the back portion and palm portion. As is further indicated in FIG. 7 it is suitable to apply to the outer side of the joint 21 a transverse protective reinforcement piece 29.

Figure 8:
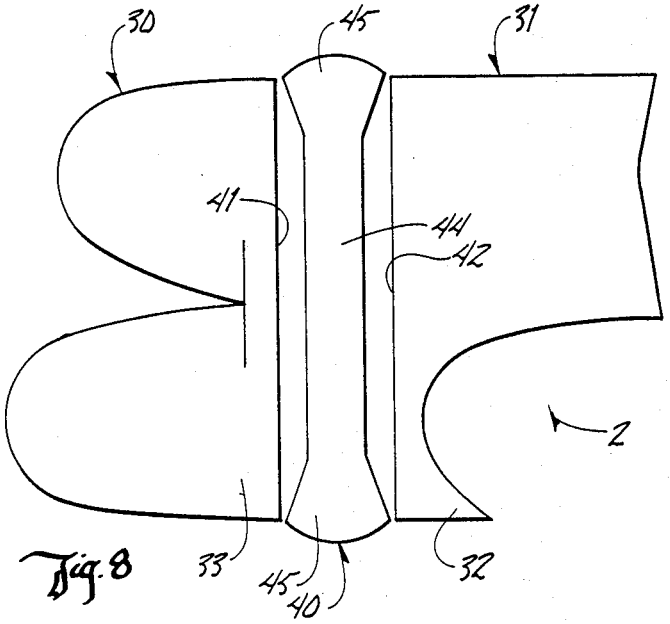
FIGS. 8–10 are views similar to FIGS. 2–4 but illustrate another modification.
Figure 9:
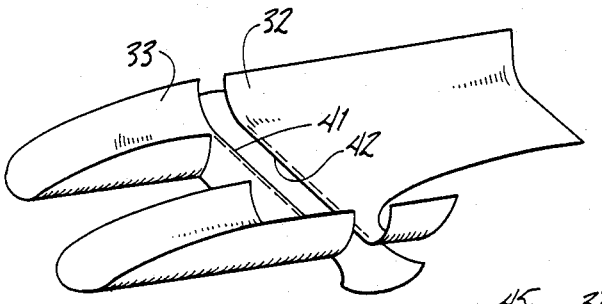
Figure 10:
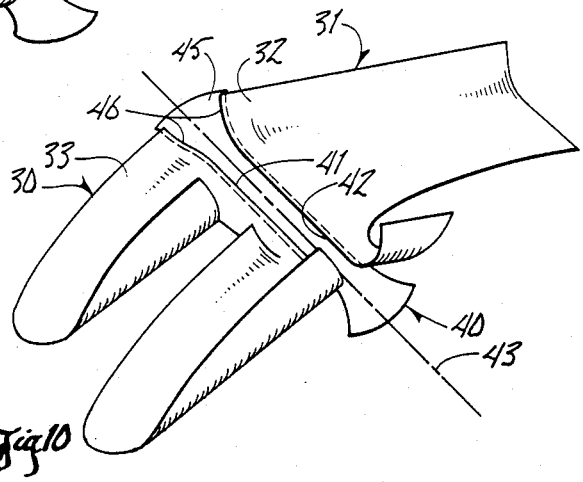

The modification in FIGS. 8–10 is similar to the embodiment in FIGS. 1–4 apart from the fact that the former has its palm portion formed by three pieces; a meta carpus piece 31, a finger piece 30 and an intermediate piece 40. The latter has a centre portion 44 and end portions 45 widened in respect thereto. The pieces 30 and 31 have generally straight edges 41, 42 facing each other. As illustrated in FIG. 10, the intermediate piece 40 is sewed on to the pieces 30 and 31 with a generally constant "overlap" and the result is, in the finished glove, a local curvature in the knuckle joint area thanks to the widened end portions 45 which are located at the sides 32, 33 of the glove. The piece 40 will form a bridge between pieces 30 and 31. Thus, the finished glove will have its sides incised at 46 and these incisions enable the provision of said curvature about 43.

It is understood that the invention is not restricted to the embodiments described above solely. As an example, it may suffice to incise the material projecting upwardly on the thumb side of the glove in the knuckle joint area since this is the most important place for a local curvature of the glove.

I claim:

1. A glove having palm and back portions joined at opposite lateral sides, the back portion (1) of which has at least one part that is extended with respect to corresponding parts of the palm portion (2) of the glove to adapt the glove to the form of a hand in its rest position with curved fingers, material portions (4, 5; 25, 26; 32, 33, 45) associated with at least one material piece (3; 19, 20; 30, 31, 40) forming the palm portion of the glove projecting upwardly along at least one side of the glove in an area, in which joints of the hand are intended to be located, characterized in that the upwardly projecting material portions (4, 5; 25, 26; 32, 33, 45) in the vicinity of said joint area is incised and assembled with respect to the rest of the glove so as to form at said incision (13, 15, 16; 21; 46) a local curvature in the palm portion in the stress-free condition of the glove.

2. A glove according to claim 1, characterized in that the glove has at least one incision at each of the opposite sides in the vicinity of the knuckle joints of the hand.

3. A glove according to claim 1, characterized in that the incision consists of a recess in the material piece (3) and that the incision is in the assembled condition of the glove widened in comparison to the form of the incision in the unassembled condition of the material piece.

4. A glove according to claim 3, characterized in that the widened incision in the assembled condition of the glove is closed by means of a closing piece (17, 18).

5. A glove according to claim 4, characterized in that the closing piece (17) is situated on the interior of the glove.

6. A glove according to claim 4, characterized in that the closing piece forms a reinforcement (18) that extends across all of the palm portion on the exterior of the glove.

7. A glove according to claim 1, characterized in that the palm portion (2) is formed of at least two material pieces (19, 20), that are assembled along a transverse joint (21) situated in the area of the knuckle joint area of the glove so as to form the curvature in this area.

8. A glove according to claim 7, characterized in that said material pieces (19, 20) in their unassembled condition have edges (27) designed for joining together, said edges extending to the opposite sides of the glove and forming at least on one side an approximately triangular projection so as to provide said curvature on joining together the edges.

9. A glove according to claim 1, characterized in that the palm portion is formed by three pieces, of which an intermediate piece (40) forms a bridge between the two other pieces in the area of the knuckle joints, and that the intermediate piece has at least one widened end portion intended for location in one side of the glove so as to form said local curvature.

10. An improved glove having a back portion and a palm portion joined at opposite lateral sides, the back portion extending with respect to the palm portion such that the glove conforms to a hand at rest with curved fingers, the palm portion having extensions projecting upwardly along at least one side of the glove in areas adjacent the intended location of the hand joints, said improvement comprising:

an incision in said extensions adjacent the intended location of the hand joints whereby a generally transversely extending curvature is formed in the palm portion.

* * * * *